US006749902B2

(12) United States Patent
Yonker et al.

(10) Patent No.: US 6,749,902 B2
(45) Date of Patent: Jun. 15, 2004

(54) METHODS FOR PRODUCING FILMS USING SUPERCRITICAL FLUID

(75) Inventors: Clement R. Yonker, Kennewick, WA (US); John L. Fulton, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 19 days.

(21) Appl. No.: 10/157,591

(22) Filed: May 28, 2002

(65) Prior Publication Data

US 2003/0222018 A1 Dec. 4, 2003

(51) Int. Cl.[7] ..... B05D 1/04; B05D 3/00

(52) U.S. Cl. ..... 427/458; 210/634; 239/3; 264/12; 427/180; 427/331; 427/336; 427/377; 427/421

(58) Field of Search ..... 264/9, 12.43; 427/331, 427/335, 336, 372.2, 377, 421, 470, 180, 422, 457, 458; 210/634, 774; 239/3, 10, 13, 690; 502/9; 424/489

(56) References Cited

U.S. PATENT DOCUMENTS

| | | | | |
|---|---|---|---|---|
| 4,582,731 A | 4/1986 | Smith | ..... | 427/421 |
| 4,734,227 A | 3/1988 | Smith | ..... | 264/13 |
| 4,734,451 A | 3/1988 | Smith | ..... | 264/12 |

(List continued on next page.)

FOREIGN PATENT DOCUMENTS

| | | |
|---|---|---|
| EP | 0 506 067 A1 | 3/1992 |
| WO | WO 99/19085 A1 | 4/1999 |
| WO | WO 01/24917 A1 | 4/2001 |
| WO | WO 01/32951 A2 | 5/2001 |
| WO | WO 01/83873 A1 | 11/2001 |
| WO | WO 01/87368 A1 | 11/2001 |
| WO | WO 01/94031 A2 | 12/2001 |

OTHER PUBLICATIONS

Mi et al., "A new study of glass transition of polymers by high pressure DSC," *Polymer* 39(16):3709 (1998).

Rindfleisch et al., "Solubility of Polymers and Copolymers in Supercritical $CO_2$," *J. Phys. Chem.* 100:15581–15587 (1996).

Smith et al., "Performance of Capillary Restrictors in Supercritical Fluid Chromatography," *Anal. Chem.* 58:2057–2064 (1986).

Tuminello et al., "Dissolving Perfluoropolymers in Supercritical Carbon Dioxide," *Macromolecules* 28:1506–1510 (1995).

Zhong et al., "High–pressure DSC study of thermal transitions of a poly(ethylene terephthalate)/carbon dioxide system," *Polymer* 40:3829–3834 (1999).

Jung et al., "Particle design using supercritical fluids: Literature and patent survey," *Journal of Supercritical Fluids* 20:179–219 (2001).

Matson et al., "Rapid Expansion of Supercritical Fluid Solutions: Solute Formation of Powders, Thin Films, and Fibers," *Ind. Eng. Chem. Res.* 26:2298–2306 (1987).

*Primary Examiner*—Joseph Drodge
(74) *Attorney, Agent, or Firm*—Klarquist Sparkman, LLP

(57) ABSTRACT

A method for forming a continuous film on a substrate surface that involves depositing particles onto a substrate surface and contacting the particle-deposited substrate surface with a supercritical fluid under conditions sufficient for forming a continuous film from the deposited particles. The particles may have a mean particle size of less 1 micron. The method may be performed by providing a pressure vessel that can contain a compressible fluid. A particle-deposited substrate is provided in the pressure vessel and the compressible fluid is maintained at a supercritical or sub-critical state sufficient for forming a film from the deposited particles. The $T_g$ of particles may be reduced by subjecting the particles to the methods detailed in the present disclosure.

61 Claims, 1 Drawing Sheet

U.S. PATENT DOCUMENTS 4,882,107 A * 11/1989 Cavender et al. ..... 264/51
5,088,443 A * 2/1992 Hastings et al. ..... 118/314
5,106,650 A 4/1992 Hoy et al. ..... 427/385.5
5,211,342 A 5/1993 Hoy et al. ..... 427/385.5
5,290,603 A 3/1994 Nielsen et al. ..... 427/421
5,639,441 A * 6/1997 Sievers et al. ..... 424/9.3
5,708,039 A * 1/1998 Daly et al. ..... 521/61
5,795,626 A * 8/1998 Gabel et al. ..... 427/258
5,817,373 A * 10/1998 Cathey et al. ..... 427/258
5,981,474 A * 11/1999 Manning et al. ..... 424/489
5,981,696 A * 11/1999 Saatweber et al. ..... 528/501
5,989,638 A * 11/1999 Nielsen ..... 427/331
6,124,226 A 9/2000 Nielsen et al. ..... 264/9
6,475,571 B1 * 11/2002 Echigo et al. ..... 427/258
6,509,136 B1 * 1/2003 Goldfarb et al. ..... 430/272.1

* cited by examiner

METHODS FOR PRODUCING FILMS USING SUPERCRITICAL FLUID

STATEMENT OF GOVERNMENT SUPPORT

This invention was made with United States Government support under Contract DE-AC0676RLO1830 awarded by the U.S. Department of Energy. The United States Government has certain rights in the invention.

FIELD

The present disclosure relates to methods for forming films on substrates.

BACKGROUND

There is a continuing need for efficient methods for producing films on substrates; particularly thin films made from polymeric materials. Formation of films from particles deposited on substrate surfaces can be accomplished by a variety of methods such as thermal sintering and chemical crosslinking or curing. In all of these methods, the glass transition temperature ($T_g$) of the particles is an important factor during film formation. In prior art methods film formation typically occurs only at temperatures higher than the $T_g$ of the particles. The $T_g$ of some commercially available materials can be in the range of about 20° C. (e.g., poly(butyl methacrylate)) to an excess of about 200° C. (e.g., poly(bisphenol A terephthalate)). At such high temperatures, the amount of heat required for film formation can lead to the chemical decomposition of the particles, complicate control of the film formation process for achieving desirable film properties, consume energy, and damage or otherwise negatively alter a temperature-sensitive substrate.

SUMMARY OF THE DISCLOSURE

Disclosed herein are methods for forming a continuous film on a substrate surface that involve depositing particles onto a substrate surface and contacting the particle-deposited substrate surface with a supercritical fluid under conditions sufficient for forming a continuous film from the deposited particles. A further method for forming a film on a substrate surface involves depositing particles having a mean particle size of less than 1 micron onto a substrate surface and contacting the particle-deposited substrate surface with a supercritical fluid under conditions sufficient for forming a film from the deposited particles.

The methods can be performed by providing a pressure vessel that can contain a compressible fluid. A particle-deposited substrate is provided in the pressure vessel and the compressible fluid is maintained at a supercritical or subcritical state sufficient for forming a film from the deposited particles.

BRIEF DESCRIPTION OF THE DRAWING

Certain embodiments will be described in more detail with reference to the following drawing.

DETAILED DESCRIPTION OF SEVERAL EMBODIMENTS

Figure 1:
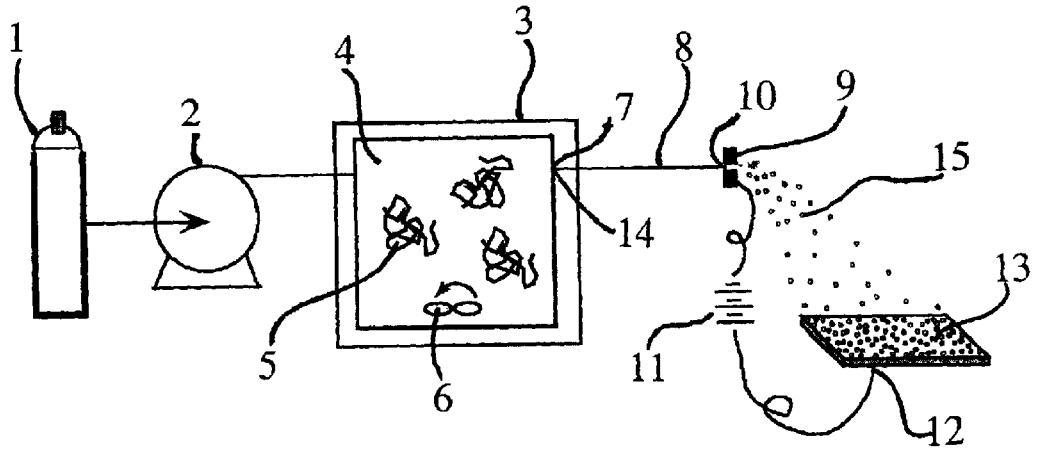
FIG. 1 is a schematic diagram of a representative apparatus for performing electrostatic deposition of particles generated from rapid expansion of supercritical fluid solutions.

For ease of understanding, the following terms used herein are described below in more detail:

"Effective $T_g$" means the $T_g$ of a material as modified by the processes disclosed herein (i.e., lowered compared to the $T_g$ at standard temperature and pressure).

"Film" refers to a layer of material that is disposed on, and contiguous with, a substrate surface. The film thickness typically is less than, often significantly less than, the thickness of the substrate. A film may also be a thin freestanding (i.e., not supported by a substrate) sheet of material.

"Continuous film" denotes a film that is substantially free of voids that are slightly less than, the same, or larger than the size of the particles utilized for formation of the film. For example, the total area occupied by voids may be less than about 10% of the total surface area encompassed by the film. Typically, any existing voids are not larger than the size of the particles utilized for formation of the film.

"Nanometer" or "nanometer-sized" denotes a material or construct whose largest dimension is less than one micron. For example, "nanometer-sized" particles have a mean particle size of less than 1 micron. Similarly, "nanometer film thickness" denotes a film thickness of less than 1 micron.

"Standard temperature and pressure" means about 1 atmosphere and about 25° C.

"Supercritical fluids" relate to materials that are at a temperature and pressure such that they are at, above, or slightly below their critical point. Thus, supercritical fluids may include near-supercritical fluids. For example, the supercritical fluid may be above the critical temperature and at a density that is from about 0.1 to about 2 times the critical density. Alternatively, the supercritical fluid may be below the critical temperature (e.g., above about 0.75 times the critical temperature) and at a density that is in a highly compressible region. The supercritical fluid may be a substance that is a gas at standard temperature and pressure, but is at a density greater than a critical density of the gas. The supercritical fluid may be a substance that is a liquid at standard temperature and pressure, but is at a temperature greater than a critical temperature of the liquid and at a pressure greater than a critical pressure of the liquid.

The above term descriptions are provided solely to aid the reader, and should not be construed to have a scope less than that understood by a person of ordinary skill in the art or as limiting the scope of the appended claims.

Disclosed herein are methods for forming a film that involve supercritical fluid coalescence of particles on a substrate surface. Discrete particles are first provided on a substrate surface by any method. A supercritical fluid is then contacted with the particles on the substrate, with or without simultaneously heating the particles, resulting in the formation of a film. Such films generally include only a very minimal amount, if any, of residual discrete particles. Although not bound by any theory, it is believed that film formation occurs due to at least one of several potential phenomena.

In the case of polymer particles, the supercritical fluid at least partially plasticizes the particles so as to promote coalescence and/or flow into a continuous film. The plasticization results from at least a portion of the supercritical fluid dissolving into the particles. Typically, the amount of supercritical fluid that dissolves into the particles is quite small, for example, in the range of about 0.02 wt. % to about 5 wt. %, more particularly about 0.02 to about 3.5 wt. %, based on the total weight of the supercritical fluid.

Polymers are viscoelastic materials. The presently disclosed methods can lower the $T_g$ of a polymer to a point where a small amount of viscous flow can occur to form a film. Such a point typically occurs in a region below, at, or above the effective $T_g$ of the polymer. The $T_g$ of the polymer particles may be sufficiently decreased to induce coalescence and/or flow of the particles without substantially dissolving the particles into the supercritical fluid. The $T_g$ of the polymer particles can be reduced significantly. For example, the $T_g$ may be reduced to an effective $T_g$ that is about 1 to about 100° C., more particularly about 5 to about 50° C., less than the $T_g$ at standard temperature and pressure depending upon the particle material and the film-forming conditions. Accordingly, film formation can be achieved at much lower temperatures compared to conventional processes thereby minimizing the possibility of chemical decomposition of the particles and damage to a temperature-sensitive substrate.

As described above, solubility of at least a portion of the supercritical fluid in the particles is a factor in film formation. Altering the density of the supercritical fluid can control the solubility of the supercritical fluid in the particles. Density is a function of pressure and temperature. Thus, if film formation is desired at a lower temperature, then the compressible gas forming the supercritical fluid can be subjected to a higher pressure. If film formation is desired at a higher temperature, then the compressible gas can be subjected to a lower pressure. In general, the greater the solubility of the supercritical fluid then the greater the reduction in $T_g$ of the polymer particles (i.e., the lower the effective $T_g$).

The supercritical fluid density may range widely provided it is sufficient to produce supercritical or near-critical conditions. The density in any particular process depends on the materials used in the process and the other process conditions. For example, the reduced density (density/density at the critical point) may be from about 0.05 to about 2, more particularly from about 0.2 to about 1.

Another potential mode of film formation applicable to particles of any type of material is a consequence of a portion of the particles dissolving into the supercritical fluid. The supercritical fluid transports the resulting solubilized material to void regions culminating in growth of a continuous film.

The particles may be contacted with the supercritical fluid in any manner. According to certain embodiments, an atmosphere constituting a supercritical fluid substantially encompasses or surrounds the particles deposited on the substrate surface. One technique for subjecting the particles to the supercritical fluid involves introducing the substrate with the particles into a pressure vessel that can contain a compressible fluid. The compressible fluid may already be present in the pressure vessel when the substrate is introduced into the pressure vessel or the compressible fluid may be introduced into the pressure vessel after introducing the substrate. The conditions (especially temperature and pressure) inside the pressure vessel are adjusted by known means so that the compressible fluid achieves a supercritical or sub-critical state sufficient for forming a film from the deposited particles. According to another variant, a substrate devoid of particles may be introduced into a pressure vessel. Particles are subsequently deposited on the substrate as it remains in the pressure vessel, and then the particle-deposited substrate is subjected to a supercritical fluid.

Although not necessarily required, heat may be applied to the particles as they are subjected to the supercritical fluid to promote film formation. The particles may be heated so that they are at or above the effective $T_g$ in the case of polymers. The heating temperature may vary widely depending upon the type of particle material and solubility of the supercritical fluid in the particles. For example, the particles may be subjected to a temperature from about 10° C. to about 450° C., more particularly about 35° C. to about 200° C. In the case of supercritical $CO_2$, the heating temperature may be from about 10° C. to about 200° C., more particularly from about 35° C. to about 50° C. Heating may be accomplished by heating the pressure vessel itself or by introducing preheated compressible fluid into the pressure vessel.

The particle-deposited substrate remains in the pressure vessel until the film formation has reached a desired point. The amount of time may vary widely depending upon the process conditions and the particle material, but, in general, the process can continue for about one minute to about 24 hours, more particularly about one minute to about one hour, most particularly from about one minute to about 10 minutes. The film formation process typically is terminated by either altering the conditions in the pressure vessel so that the compressible fluid is no longer in a supercritical or near-supercritical state or by removing the substrate from the pressure vessel.

The methods detailed herein may be performed in a batch, semi-continuous, or continuous manner. In a continuous process, the pressure vessel may be provided with an interface such as a pressure lock for transporting the substrate (and particles deposited thereon) from ambient atmosphere into a higher-pressure atmosphere. One variant of a continuous process could involve transporting a continuous sheet of particle-deposited material through a series of pressure-sealing rollers into, and then out of, a higher pressure region. In a semi-continuous process, at least two pressure vessels may be configured in a parallel arrangement relative to each other. A first substrate would be introduced into a first pressure vessel that would subsequently be filled with a supercritical fluid. When film formation was complete in the first pressure vessel the supercritical fluid would be removed and transferred to a second pressure vessel that contains a second substrate. Film formation on the second substrate commences when the pressure of the supercritical fluid reaches a certain point. After removal of substantially all the supercritical fluid from the first vessel the first substrate carrying the film would be removed from the first vessel. Film formation would simultaneously proceed in the second vessel until completion and then the entire supercritical fluid transfer process would be repeated.

Any particles that can form a film as described herein can be utilized. In general, the process could be used with particles having a mean particle size of, for example, about 10 nm to about 1 mm. Smaller particles typically should be more amenable to film formation. Thus, according to particular embodiments the particles have a mean particle size equal to or less than about 1 micron. Especially useful are particles that have a mean particle size less than 1 micron.

The types of materials that may be employed in the film formations detailed herein may be any solid material that can form particles and into which a supercritical fluid can at least partially dissolve or which is at least partially soluble in a supercritical fluid. Illustrative materials include polymers (organic and organometallic), non-polymeric organic materials (dyes, pharmaceuticals), non-polymeric inorganic materials (e.g., metals, metallic salts, alloys, pigments, etc), and mixtures thereof. Examples of polymeric materials include poly(vinyl chloride), polyarylenes (e.g., polystyrene), polyolefins (e.g., polypropylene and polyethylene), fluoropolymers (e.g., perfluorinated polyethylene and other halogenated polyolefins), poly(carbosilane), poly(phenyl sulfone), polyacrylates (e.g., poly(methyl methacrylate), polymethylacrylate), polycaprolactone, polyamides, polyimides, and polyurethanes. Polymer precursors (i.e., monomers or oligomers) that could undergo polymerization during the film formation process could also be employed. Examples of inorganic materials include $SiO_2$, KI, $GeO_2$, AgI, chromium materials, copper materials, aluminum materials, nickel materials, palladium materials, and platinum materials. Examples of organic materials include anthracene, benzoic acid, caffeine, cholesterol, and flavones. Examples of pharmaceutical compounds include aspirin, ibuprofen, alpha-tocopherol, stimasterol, anti-inflammatory agents (e.g., steroids), antibiotics, anti-viral agents, anti-neoplastic agents (e.g., etoposide), and antihistamines. Mixtures of such materials can be utilized. In other words, particles from a first material can be deposited on a substrate and particles from a second material can also be deposited on the substrate, either simultaneously with, or subsequent to, the deposition of the first material.

The particles may be deposited on the substrate by any deposition or coating method. Illustrative deposition or coating methods include meniscus (e.g., dip), blade or knife, gravure, roll, extrusion, slot, curtain, spray (including electrostatic), fluidized bed (including electrostatic), and flocking. A dispersion or emulsion of particles in a liquid carrier may be applied to the substrate surface resulting in deposition of the particles on the surface. Especially useful methods for depositing micron-sized or nanometer-sized particles include spray, fluidized bed, dip coating from a liquid, rapid expansion of supercritical solvent ("RESS"), and supercritical fluid anti-solvent ("SAS").

Illustrative particles that could be used include those typically used for spray coating, lattices and similar dispersions or emulsions, and powder coating. For example, particles deposited from dispersion or emulsions include acrylics, urethanes, and phenolic resins. Powder coating substances include thermoplastics such as plasticized poly (vinyl chloride), polyamides, and other specialty thermoplastics; and thermosets such as polyacrylates (e.g., poly (butyl acrylate) and ethyl acrylate/2-ethylhexyl acrylate), epoxies, urethane polyesters, and unsaturated polyester resins. The shape of the particles is not critical. The particles may be substantially spherical, irregularly shaped, rod-shaped, or fibrous in shape.

The amount of particles deposited on the substrate is not critical and may vary widely. There may be measurable voids between the particles. For example, the total area occupied by voids between the deposited particles may be greater than about 40 or 50% of the total surface area encompassed by the deposition area. Greater densities of deposited particles generally result in thicker films. According to particular embodiments, the particles deposited on the substrate do not form a film until the substrate is contacted with the supercritical fluid.

Illustrative supercritical fluid substances that could be used in the presently described methods include carbon dioxide, hydrocarbons, ammonia, ethylene, acetone, diethyl ether, $N_2O$, xenon, argon, sulfur hexafluoride and water. Examples of hydrocarbons include alkanes (e.g., ethane, propane, butane and pentane), alkenes (ethylene, propylene, and butene), alkanols (e.g., ethanol, methanol, isopropanol, and isobutanol), halogenated hydrocarbons (e.g., chlorotrifluoromethane, chlorodifluoromethane and monofluoromethane), carboxylic acids (e.g., acetic acid and formic acid), fluorinated compounds (perfluorooctanol, perfluorohexane, and 2,3-dihydrodecafluoropentane), aromatic compounds (e.g., benzene, toluene, m-cresol, o-xylene, pyridine, aniline, decahydronaphthalene, and tetrahydronaphthalene), and cyclic saturated hydrocarbons (e.g., cyclohexane and cyclohexanol).

At least one optional secondary solvent may be included with the supercritical fluid. Illustrative secondary solvents include acetone, methanol, ethanol, water, pentane, and acetic acid. Such secondary solvents typically would not be included in an amount greater than 10 weight percent of the total supercritical fluid mixture. Other optional additives may be included in the supercritical fluid such as surfactants, chelates, and organometallic compounds.

As mentioned above, one especially useful method for depositing particles is known as RESS. The RESS process is generally described in U.S. Pat. Nos. 4,582,731; 4,734,227; and 4,734,451. The rapid expansion of supercritical fluid solutions through a small orifice produces an abrupt decrease in dissolving capacity of the solvent as it is transferred from a supercritical fluid state, having near liquid density, to a very low density phase after the expansion. This abrupt transition in solvent characteristics results in the nucleation and growth of nanometer-sized particles from any low vapor pressure solute species that are dissolved in the solution prior to expansion. Because the solvent is transformed into the gas phase during the RESS expansion, RESS products are generated "dry" since they are substantially free of residual solvent.

In particular, the RESS process involves dissolving at least a portion of a solute material in a supercritical fluid solvent. The resulting solution is maintained in a supercritical fluid state and then released (and initially expanded) through an orifice and into a relatively lower pressure region (i.e., approximately atmospheric or subatmospheric). A single homogeneous supercritical phase exists up to the inlet or proximate end of the orifice. The particle formation occurs primarily beyond the exit tip or distal end of the orifice. In this region the high-pressure fluid undergoes an expansion to gas densities in extremely short times (e.g., less than about $10^{-5}$ s). Homogeneous nucleation occurs in this rapid expansion that leads to formation of nanometer-sized particles. In the transition region from the exit tip out to approximately 1 mm beyond the exit tip, the fluid accelerates to sonic velocities forming a shock wave. This involves a phase transition from a single supercritical fluid phase to a two-phase system of either vapor/solid or vapor/liquid.

A commonly-assigned, concurrently filed U.S. patent application entitled "Electrostatic Deposition of Particles Generated from Rapid Expansion of Supercritical Fluid Solutions" describes methods for electrostatically depositing particles generated by RESS. Specifically, the methods involve forming a supercritical fluid solution of at least one supercritical fluid solvent and at least one solute, discharging the supercritical fluid solution through an orifice under conditions sufficient to form particles of the solute that are substantially free of the supercritical fluid solvent, and electrostatically depositing the solute particles onto the substrate. These electrostatic deposition methods are described below in more detail.

The effectiveness of the electrostatic deposition methods is surprising in light of the above-described severe phase transition regime involved in RESS. Specifically, in the region beyond the orifice exit tip where the particles are forming, more gas-like conditions exist with extremely high particle velocities. Prior to the present disclosure, the likelihood of sufficient charge conduction through a gas-like phase traveling over very short distances at near sonic velocity would be viewed as highly improbable. Moreover, the electrical conductivity of the supercritical fluid solution is dramatically lower compared to a liquid phase solution as used in conventional electrostatic spraying. A lower electrical conductivity means that it is more difficult for charge transfer to occur.

Electrostatic deposition takes advantage of the phenomenon that particles charged at a first potential are electrostatically attracted to a substrate that is held at a second potential or at electric ground. The particles may be subjected to an external electrical field via any suitable technique. One particularly useful approach involves applying a high voltage to the expansion nozzle to charge the RESS particles as they are being formed. In both embodiments, the electrostatic attraction between the RESS particles and the substrate forces the particles to the substrate surface.

An option for charging the particles involves providing an electrode or an array of electrodes that can generate an electrical field that is applied to the particles. For example, the particles may be subjected to the electrical field after they exit the expansion orifice by placing an electrode near the orifice exit. Indeed, it has been found that the most efficient deposition occurs if the electrode is located within about 0.1 mm to about 1 cm of the orifice outlet, preferably within about 0.75 mm. Alternatively, the expansion orifice could be constructed from a conducting material that is itself charged. The charge then can be transferred to the solute material as it passes through the orifice via generation of charged species in the supercritical solution due to the high field strengths in the vicinity of the expanding jet. The electrode may be charged to any suitable voltage that results in the desired field strengths for deposition. For example, the field strength may range from about 0.1 kV/cm to about 75 kV/cm, more particularly from about 1 kV/cm to about 10 kV/cm. Additional methods for particle charging include generating a corona discharge in the expanding supercritical solution jet. The applied electrode voltage may be substantially constant, modulated or stepped. Modulating or stepping of the voltage enhances particle coating on the interior surfaces of objects that define voids such as cylindrical structures.

The substrate may be charged at a potential that is opposite that of the particles or at a potential that is the same sign as the particles but at a lower or higher voltage. Alternatively, the substrate may be grounded. Any technique may be utilized to charge the substrate. For example, an electrode may be in electrical contact with the substrate or an array of electrodes may serve as the substrates. According to a further embodiment, the substrate may be sufficiently electrically isolated so that an electrostatic charge can be accumulated on the substrate. One technique of accumulating the charge is by taking advantage of the photoelectric effect. In this method the substrate is exposed to electromagnetic radiation effective to strip charges, typically electrons, from the surface of the substrate. Other methods include induction charging or tribocharging, plasma treatment, corona charging, and ion implantation. Another method of electrostatically depositing charged deposition materials to a surface has been termed "controlled field deposition," and typically involves applying a potential to an electrode which directly or indirectly results in the formation of an attractive electrical field at the surface upon which charged material will be deposited. For example, a substrate can have electrical conductors positioned below the deposition surfaces, and a potential applied to the conductors results in the formation of an attractive field at the surface.

Nanometer-sized particles (or "nanoparticles") are generated during the rapid expansion of supercritical fluid solutions. For example, the mean particle size may be less than 1 micron. According to certain embodiments, the mean particle size may be from about 20 nm to about 200 nm. Collection of such nanometer-sized particles is difficult with conventional systems since the particles tend to follow gas stream lines or remain suspended in gases. The disclosed methods solve this problem.

The size of the particles are so small that they can be deposited to electrically conducting microscopic regions with a deposition resolution better than 50 nm. According to certain embodiments, a deposition resolution of approximately 50 million dots of deposited substance/inch can be achieved. This characteristic of the process allows one to create intricate designs on a substrate by embedding an intricate pattern of conducting material in a nonconducting substrate. The particles will only coat the conducting material pattern and not the adjoining nonconducting substrate.

The particles can have varying shapes depending upon the solute material and the process conditions. For example, the particles may be substantially spherical, irregularly shaped, rod-shaped or fibrous in shape. The fibers may have an aspect ratio ranging from about 10 to more than one thousand, with diameters of about 0.01 $\mu$m to about 1 $\mu$m.

According to one variant of the electrostatic deposition methods, the particles generated by the RESS process are solid particles of the solute that are substantially free of the supercritical fluid solvent. Solid particles typically are produced when the solute material exists as a solid at ambient conditions (i.e., 25° C. and 1 atmosphere). In another variant, the particles generated by the RESS process are liquid particles or droplets of the solute that are substantially free of the supercritical fluid solvent. Liquid droplets typically are produced when the solute material exists as a liquid at ambient conditions. Examples of such liquid solutes include organosiloxanes such as polydimethylsiloxane, polyethylene glycol dodecyl ether, decanoic acid, octanol, 2-octanone, n-dodecane, and perfluorodecane.

Modifying the RESS process as described in U.S. Pat. No. 4,734,227 can produce fiber-shaped particles. In particular, the RESS process is modified so that the solute passes briefly through an intermediate liquid phase, rather than directly to a solid, from the solution. One way to do this is to raise the solution temperature to just above the melting point of the solute. Another is to use a small amount (<20 weight %) of a supercritical solvent modifier or entrainer having a higher critical temperature than the main solvent component and substantial solubility with the polymer. Acetone provides a suitable such secondary solvent or co-solvent for many classes of polymers and others can be readily determined. The concentration of the secondary solvent should be sufficiently low that, upon expansion through the orifice and vaporization of the primary supercritical solvent, particles of a low-viscosity solution of the polymer and secondary supercritical fluid solvent are initially formed within the nozzle. The latter technique is used with normally solid solutes that do not have appropriate melting points for use with a single supercritical solvent.

A further feature of the presently described methods is the ability to precisely control the deposition so that almost any desired film thickness can be produced. For example, film thickness of less than about 500 nm, particularly less than about 20 nm, can be achieved. Maximum achievable film thickness are essentially unlimited, but generally can be up to about 10 microns, particularly about 1 micron, thick. The film thickness may be primarily controlled by the length of time of electrostatic deposition. Other factors that may control the film thickness include concentration of the solute in the supercritical solution, the diameter of an orifice through which the supercritical solution is discharged, and the electrostatic deposition field strength.

The amount of solute material or substance mixed with the supercritical solvent may vary, provided the resulting mixture forms a supercritical solution. In general, about 3.0 weight percent or less of a solute, more particularly about 1.0 weight percent or less, most particularly about 0.1 weight percent or less, based on the total weight of the supercritical fluid and the solute combined, is mixed with the supercritical solvent. The minimum amount of solute could range down to about 0.005 weight percent. The viscosity of the sprayed supercritical solution is approximately the same or slightly above the viscosity of the supercritical solvent itself. For example, the viscosity of a supercritical solution that includes $CO_2$ as the solvent according to the presently disclosed methods is about 0.08 centipoise at 60° C. and 300 absolute bar, and is about 0.10 centipoise at 110° C. and 900 absolute bar.

The substances (or a suitable precursor) that may be electrostatically deposited include any substances that can sufficiently dissolve in a supercritical fluid solvent. Illustrative materials include polymers (organic and organometallic), non-polymeric organic materials (dyes, pharmaceuticals), non-polymeric inorganic materials (e.g., metals, metallic salts, alloys, etc), and combinations thereof. Examples of polymeric materials include poly(vinyl chloride), polyarylenes (e.g., polystyrene), polyolefins (e.g., polypropylene and polyethylene), fluoropolymers (e.g., perfluorinated polyethylene and other halogenated polyolefins), poly(carbosilane), poly(phenyl sulfone), polyacrylates (e.g., poly(methyl methacrylate), polymethylacrylate), polycaprolactone, polyamides, polyimides, and polyurethanes. Examples of inorganic materials include $SiO_2$, KI, $GeO_2$, AgI, chromium materials, copper materials, aluminum materials, nickel materials, palladium materials, and platinum materials. Examples of organic materials include anthracene, benzoic acid, caffeine, cholesterol, and flavones. Examples of pharmaceutical compounds include aspirin, ibuprofen, alpha-tocopherol, stimasterol, anti-inflammatory agents (e.g., steroids), antibiotics, anti-viral agents, anti-neoplastic agents (e.g., etoposide), and antihistamines.

The supercritical fluid solvent may be any supercritical fluid that has solvating properties. Illustrative substances include carbon dioxide, hydrocarbons, ammonia, ethylene, acetone, diethyl ether, $N_2O$, xenon, argon, sulfur hexafluoride and water. Examples of hydrocarbons include alkanes (e.g., ethane, propane, butane and pentane), alkenes (ethylene, propylene, and butene), alkanols (e.g., ethanol, methanol, isopropanol, and isobutanol), halogenated hydrocarbons (e.g., chlorotrifluoromethane, chlorodifluoromethane and monofluoromethane), carboxylic acids (e.g., acetic acid and formic acid), fluorinated compounds (perfluorooctanol, perfluorohexane, and 2,3-dihydrodecafluoropentane), aromatic compounds (e.g., benzene, toluene, m-cresol, o-xylene, pyridine, aniline, decahydronaphthalene, and tetrahydronaphthalene), and cyclic saturated hydrocarbons (e.g., cyclohexane and cyclohexanol). According to particular embodiments, the supercritical fluid solvent is a substance such as carbon dioxide that does not easily transfer or conduct an electrical charge. A feature of the presently disclosed methods is that several of the supercritical fluid solvents are environmentally benign such as carbon dioxide, xenon, argon, chlorodifluoromethane, and water. The critical temperature and critical pressure for achieving a supercritical fluid state is generally known for each of the above-described solvents. The critical temperature and critical pressure for other solvents can be determined by techniques known in the art. With respect to the supercritical fluid solution resulting from mixing the solute with the solvent, the critical temperature and critical pressure may be approximately the same for the pure solvents but could deviate as the solute concentration increases. The supercritical solution typically is a substantially single-phase solution that is above the critical density of the substantially pure supercritical fluid solvent.

At least one optional secondary solvent may be included in the solution provided it does not interfere with maintaining the solution in a supercritical fluid state. Illustrative secondary solvents include acetone, methanol, ethanol, water, pentane, and acetic acid. Such secondary solvents typically would not be included in an amount greater than 10 weight percent of the total mixture or solution. Other optional additives may be included in the solution such as surfactants, chelates, and organometallic compounds.

The presently disclosed electrostatic deposition methods can be used to generate a solid matrix with nanometer size amorphous domains of two or more chemically diverse solid materials. For example, more than one solute substance could be mixed with the supercritical fluid solvent. In particular, materials that are insoluble with each other in the solid state or that are not both soluble in conventional organic solvents or water may be mixed and sprayed together resulting in a solid nanoscale dispersion or matrix of the materials. Alternatively, a plurality of different materials could be dissolved in separate chambers holding supercritical fluid solvents. The sprays from each distinct supercritical fluid solution could be mixed during electrostatic deposition to produce a solid nanoscale dispersion or matrix of the materials. This variant might be useful for producing a coating of a polymer matrix that incorporates a pharmaceutical substance. The polymer-containing supercritical solution could be prepared in one chamber at a higher temperature (e.g., from about 100° C. to about 250° C.) and the fragile or labile pharmaceutical-containing supercritical solution could be prepared in a second chamber at a lower temperature (e.g., from about 25° C. to about 100° C.). Alternate layers of materials also could be sprayed to produce coatings with multi-tailored properties.

Any devices capable of providing the rapid expansion of the supercritical fluid solution can be employed to perform the electrostatic deposition methods. A representative example of a suitable apparatus is shown in FIG. 1. An additional example of a RESS apparatus is shown in U.S. Pat. No. 4,582,731 (see FIGS. 4–6). In general, the supercritical solvent is pumped and/or heated to the desired pressure and/or temperature resulting in a supercritical fluid state. The solute material can be mixed with the supercritical fluid solvent via any known mixing techniques such as extraction, baffle mixing, impinging jet mixers, or a magnetic stir bar. The resulting supercritical fluid solution is introduced into at least one orifice or other configuration that can cause a rapid expansion of the solution. The orifice may have an elongated or cylindrical geometry such that the supercritical fluid solution flows through a narrow passage. In particular embodiments, the orifice is a capillary. A nozzle defining one or more orifices may be utilized. The dimensions of the orifice may vary depending upon the materials and the desired pressure drop. For example, the length of the orifice may be from about 50 microns to about 5 mm long. The orifice opening may have any geometry but typically is generally spherical or oval. The largest dimension of the orifice opening may vary such as, for example, from about 10 microns to about 1000 microns. In the case of a capillary, the capillary may have a length of about 1 cm to about 200 cm. The distance from the orifice outlet to the substrate surface may vary depending upon the specific configuration, desired coating area, field strengths, and material. For example, the distance may range from about 2 cm to about 200 cm.

With reference to FIG. 1, a container 1 for holding the supercritical fluid solvent is fluidly coupled to a pump 2. The pressure of the supercritical fluid solvent may be increased to the desired level via the pump 2. A pressurized vessel 3 is fluidly coupled to the pump 2 so that the pressurized vessel 3 can receive the supercritical fluid solvent 4. Heating means (not shown) may be provided for the pressurized vessel 3. A solute substance 5 is dissolved in the supercritical fluid solvent 4 in the pressurized vessel 3. Alternatively, the solute substance 5 may be mixed with supercritical fluid solvent 4 under conditions that are initially insufficient to induce a supercritical fluid solution, but the resulting mixture is subsequently subjected to pressure and/or temperature conditions sufficient for formation of the supercritical fluid solution. A magnetic stir bar 6 is provided to thoroughly mix the solute substance 5/supercritical fluid solvent 4 mixture resulting in a supercritical fluid solution. A wall of the pressurized vessel 3 defines an outlet 7 for discharging the supercritical fluid solution through a capillary restrictor nozzle 8. The capillary restrictor nozzle 8 may be constructed from an electrical insulator material such as quartz or polyetheretherketone. A proximate end 14 of the capillary restrictor nozzle 8 may be immersed in the supercritical fluid solution. The capillary restrictor nozzle 8 may be heated to avoid plugging by solute precipitate. More than one nozzle may be provided. A first electrode 9 of a power source 11 is coupled to a distal end 10 of the capillary restrictor nozzle 8. A second electrode 12 of the power source 11 is coupled to a substrate 13. The first and second electrodes 9, 12 may be any structure known in the art such as wires, plates, clips, and the like. For example, the first electrode 9 may be a metal wire that extends beyond the distal end 10 of the capillary restrictor nozzle 8 and is secured thereto by suitable means. Alternatively, the first electrode 9 may be an annular ring that encompasses the distal end 10 of the capillary restrictor nozzle 8. The first electrode 9 may be aligned in any orientation with respect to the spray of RESS particles. In the case where the first electrode 9 is an annular ring, the plane in which the annular ring lies is aligned substantially parallel to the plane formed by the exit surface of the capillary restrictor nozzle 8.

The supercritical solution undergoes RESS as it flows through and exits the capillary restrictor nozzle 8. A spray of RESS particles 15 exits the distal end 10 of the capillary restrictor nozzle 8. A voltage is applied to the first and second electrodes 9, 12. The electric potential difference between the first electrode 9 and the second electrode 12 attracts the RESS particles 15 to the substrate 13. The solvent gas may be removed from the deposition field by simply providing a suitable gas flow. A chamber (not shown) enveloping the capillary restrictor nozzle 8 and the substrate 13 may be provided to enhance formation of the RESS particles. For example, an insulator such as a glass bell jar may encompass the capillary restrictor nozzle 8 and the substrate 13. An insulator material provides a superior configuration for precisely controlling the grounding or charging of the substrate. The interior of the chamber may be at atmospheric or sub-atmospheric pressure. Spraying or discharging into an atmospheric ambient avoids the potentially costly effort of maintaining a sub-atmospheric pressure.

The electrostatically deposited coatings may be characterized by the initial formation of a coating of individual RESS nanoparticles. The RESS nanoparticles can then be subjected to the film-forming process disclosed herein.

The types of substrates upon which the films may formed are not critical and may vary widely. Illustrative substrates include molded articles made from elastomers or engineering plastics, extruded articles such as fibers or parts made from thermoplastics or thermosets, sheet or coil metal goods, ceramics, glass, substrates previously coated with a metallic or polymeric material, and the like. Examples of substrate devices include medical devices such as stents and microelectronic devices such as semiconductor chips.

Illustrative elastomeric substrate materials include natural rubber or synthetic rubber such as polychloroprene, polybutadiene, polyisoprene, styrene-butadiene copolymer rubber, acrylonitrile-butadiene copolymer rubber ("NBR"), ethylene-propylene copolymer rubber ("EPM"), ethylene-propylene-diene terpolymer rubber ("EPDM"), butyl rubber, brominated butyl rubber, alkylated chlorosulfonated polyethylene rubber, hydrogenated nitrile rubber ("HNBR"), silicone rubber, fluorosilicone rubber, poly(n-butyl acrylate), thermoplastic elastomer and the like as well as mixtures thereof.

Illustrative engineering plastic substrate materials include polyester, polyolefin, polyamide, polyimide, polynitrile, polycarbonate, acrylic, acetal, polyketone, polyarylate, polybenzimidazoles, polyvinyl alcohol, ionomer, polyphenyleneoxide, polyphenylenesulfide, polyaryl sulfone, styrenic, polysulfone, polyurethane, polyvinyl chloride, epoxy and polyether ketones.

Illustrative metallic substrate materials include iron, steel (including stainless steel and electrogalvanized steel), lead, aluminum, copper, brass, bronze, MONEL metal alloy, nickel, zinc, tin, gold, silver, platinum, palladium and various alloys of such materials.

Further substrate materials include silica, alumina, concrete, paper, and textiles.

The film may be formed at the interface between the substrate surface and the deposited particles. The resulting film typically is a continuous solid film having a thickness that may be substantially uniform or varied as desired. The film thickness may range, for example, from about 1 nm to about 10 microns, particularly about 100 nm to about 500 nm. The resulting films may serve functional and/or decorative aesthetic purposes. The film should have the qualitative characteristics of the material from which it is formed. Adhesion of the film to the substrate surface can be enhanced by substrate surface preparation or electrically charging the substrate.

The specific examples described below are for illustrative purposes and should not be considered as limiting the scope of the appended claims.

EXAMPLE 1

An ultra-fine wire mesh screen (wire diameter of about 66 microns) was coated with a thin layer of fluoropolymer particles having diameters of about 200 nm via electrostatic deposition of the RESS-generated fluoropolymer particles. Specifically, 46.1 mg of a copolymer of tetrafluoroethylene/hexafluoropropylene/vinylidene fluoride (THV 220A) was dissolved in supercritical carbon dioxide at 110° C. and 14,000 psi. The resulting solution was sprayed onto the screen at a flow rate of about 3 ml/minute. The electrode was charged to a voltage that provided a field strength of about 2.5 kV/cm.

The particle-coated screen then was placed into a pressure vessel and heated to 40° C. Supercritical $CO_2$ was introduced into the pressure vessel at a pressure of approximately 2000 psi. After immersion under these conditions for about 10 minutes the pressure was released and the screen removed.

Inspection of the screen under a high power microscope showed that the particles had coalesced into a uniform film. Based on gravimetric measurements, the film thickness was 1.5 microns.

Having illustrated and described the principles of the disclosed methods and substrates with reference to several embodiments, it should be apparent that these methods and substrates may be modified in arrangement and detail without departing from such principles.

What is claimed is:

1. A method for forming a continuous film on a substrate surface, comprising:

depositing particles onto a substrate surface; and contacting the particle-deposited substrate surface with a supercritical fluid under conditions sufficient for forming a continuous film from the deposited particles.

2. The method of claim 1, wherein the depositing of the particles on the substrate surface does not form a film prior to contacting the particle-deposited substrate surface with the supercritical fluid.

3. The method of claim 1, further comprising heating the particle-deposited substrate surface during the contacting with the supercritical fluid.

4. The method of claim 3, wherein the particles comprise polymer particles and the supercritical fluid comprises carbon dioxide.

5. The method of claim 3, wherein the heating temperature ranges from about 10 to about 450° C.

6. The method of claim 1, wherein the particles have a mean particle size of about 10 nm to about 1 mm.

7. The method of claim 1, wherein the particles have a mean particle size equal to or less than about 1 micron.

8. The method of claim 1, wherein at least a portion of the supercritical fluid dissolves into the particles.

9. The method of claim 1, wherein the depositing of the particles comprises spraying, coating, or electrostatically depositing the particles onto the substrate surface.

10. The method of claim 9, wherein a dispersion or emulsion of particles in a liquid carrier is applied to the substrate surface.

11. The method of claim 1, wherein the particles comprise polymer particles and the supercritical fluid comprises carbon dioxide.

12. The method of claim 1, wherein the supercritical fluid has a density that is from about 0.1 to about 2 times the critical density of the supercritical fluid.

13. The method of claim 1, wherein at least a portion of the particles dissolves into the supercritical fluid.

14. The method of claim 1, further comprising mixing a secondary solvent with the supercritical fluid.

15. A substrate comprising a continuous film on at least one surface of the substrate formed according to the method of claim 1.

16. The substrate of claim 15, wherein the film has a thickness of about 1 nm to about 10 microns.

17. The substrate of claim 16, wherein the film has a thickness of about 1 nm to about 10 microns.

18. The method of claim 1, wherein the particles comprise an organometallic material.

19. A method for forming a film on a substrate surface, comprising:

depositing particles having a mean particle size of less than 1 micron onto a substrate surface; and contacting the particle-deposited substrate surface with a supercritical fluid under conditions sufficient for forming a film from the deposited particles.

20. The method of claim 19, wherein the depositing of the particles on the substrate surface does not form a film prior to contacting the particle-deposited substrate surface with the supercritical fluid.

21. The method of claim 19, further comprising heating the particle-deposited substrate surface during the contacting with the supercritical fluid.

22. The method of claim 21, wherein the heating temperature ranges from about 10 to about 450° C.

23. The method of claim 21, wherein the particles comprise polymer particles and the supercritical fluid comprises carbon dioxide.

24. The method of claim 19, wherein at least a portion of the supercritical fluid dissolves into the particles.

25. The method of claim 19, wherein the depositing of the particles comprises spraying, coating, or electrostatically depositing the particles onto the substrate surface.

26. The method of claim 25, wherein a dispersion or emulsion of particles in a liquid carrier is applied to the substrate surface.

27. The method of claim 19, wherein the particles comprise polymer particles and the supercritical fluid comprises carbon dioxide.

28. The method of claim 19, wherein the supercritical fluid has a density that is from about 0.1 to about 2 times the critical density of the supercritical fluid.

29. The method of claim 19, wherein at least a portion of the particles dissolves into the supercritical fluid.

30. The method of claim 19, further comprising mixing a secondary solvent with the supercritical fluid.

31. A method for forming a continuous film on a substrate surface, comprising:

depositing polymer particles having a mean particle size of less than 1 micron onto a substrate surface; and reducing the glass transition temperature ($T_g$) of the polymer particles by subjecting the polymer particle-deposited substrate surface to a supercritical fluid.

32. The method of claim 31, wherein the $T_g$ of the polymer particles is reduced from about 1 to about 100° C. relative to the $T_g$ of the polymer particles at standard temperature and pressure.

33. A method for forming a continuous film on a substrate surface, comprising:

providing a pressure vessel that can contain a compressible fluid;

providing in the pressure vessel a substrate defining at least one surface having particles deposited thereon; and maintaining compressible fluid in the pressure vessel at a supercritical or sub-critical state sufficient for forming a continuous film from the deposited particles.

34. The method of claim 33, wherein the providing the substrate in the pressure vessel comprises introducing a particle-deposited substrate into the pressure vessel.

35. The method of claim 34, comprising depositing the particles on the substrate surface by spraying, coating, or electrostatic deposition.

36. The method of claim 35, wherein a dispersion or emulsion of particles in a liquid carrier is applied to the substrate surface.

37. The method of claim 33, wherein the maintaining of the compressible fluid in the pressure vessel comprises introducing a supercritical fluid into the pressure vessel.

38. The method of claim 29, wherein the supercritical fluid is introduced into the pressure vessel after the substrate has been provided in the pressure vessel.

39. The method of claim 33, further comprising heating the pressure vessel.

40. The method of claim 33, wherein the particles have a mean particle size of about 10 nm to about 1 mm.

41. The method of claim 33, wherein the particles have a mean particle size of less than 1 micron.

42. The method of claim 33, wherein the maintaining of the compressible fluid in the pressure vessel comprises introducing a compressible fluid into the pressure vessel and then subjecting the compressible fluid to conditions sufficient for maintaining the compressible fluid at a supercritical or sub-critical state.

43. The method of claim 42, wherein at least one of the temperature or pressure of the compressible fluid is increased so that the compressible fluid is at a supercritical or sub-critical state.

44. The method of claim 33, wherein the compressible fluid has a density that is from about 0.1 to about 2 times the critical density of the compressible fluid.

45. A method for forming a film on a substrate surface, comprising:

forming a supercritical fluid solution that includes at least one first supercritical fluid solvent and at least one solute;

discharging the supercritical fluid solution through an orifice under conditions sufficient to form particles of the solute that are substantially free of the supercritical fluid solvent;

electrostatically depositing the solid solute particles onto the substrate; and contacting the particle-deposited substrate surface with a second supercritical fluid under conditions sufficient for forming a film from the deposited particles.

46. The method of claim 45, wherein the solute comprises a polymer, an inorganic substance, or a pharmaceutical substance.

47. The method of claim 45, wherein the first supercritical fluid solvent and the second supercritical fluid comprise carbon dioxide.

48. The method of claim 45, wherein the supercritical fluid solution includes at least a first solute and a second solute and the solute particles electrostatically deposited onto the substrate form a solid nanoscale dispersion of first solute particles and second solute particles.

49. The method of claim 45, wherein the orifice comprises a capillary.

50. The method of claim 45, further comprising charging the solute particles to a first electric potential and charging the substrate to a second electric potential that is opposite the first electric potential of solute particles.

51. The method of claim 50, further comprising heating the particle-deposited substrate surface during the contacting with the second supercritical fluid.

52. The method of claim 45, wherein the solute comprises a fluoropolymer and the first supercritical fluid solvent comprises carbon dioxide.

53. The method of claim 45, further comprising heating the particle-deposited substrate surface during the contacting with the second supercritical fluid.

54. The method of claim 45, wherein the particles have a mean particle size less than about 1 micron.

55. The method of claim 45, wherein at least a portion of the supercritical fluid dissolves into the particles.

56. The method of claim 45, further comprising charging the solute particles to a first electric potential and electrically grounding the substrate.

57. The method of claim 56, further comprising heating the particle-deposited substrate surface during the contacting with the second supercritical fluid.

58. The method of claim 45, wherein the first supercritical fluid solvent and the second supercritical fluid comprise the same supercritical fluid.

59. A substrate comprising a film on at least one surface of the substrate formed according to the method of claim 45.

60. The method of claim 45, wherein the particles have a mean particle size of less than about 200 nm.

61. The method of claim 45, wherein about 3.0 weight percent or less of the solute is present in the supercritical fluid solution.

* * * * *